US005459972A

United States Patent [19]

Eckel

[11] Patent Number: 5,459,972

[45] Date of Patent: Oct. 24, 1995

[54] IMPACT DOOR CONSTRUCTION AND METHOD OF MANUFACTURE

[76] Inventor: Alan Eckel, 10 Hildreth St., Westford, Mass. 01886

[21] Appl. No.: 60,737

[22] Filed: May 10, 1993

[51] Int. Cl.[6] ..... E06B 3/70

[52] U.S. Cl. ..... 52/456

[58] Field of Search ..... 52/455, 316, 456, 52/809, 455, 457, 458, 492, 809, 813, 821, 829; 49/501, 171

[56] References Cited

U.S. PATENT DOCUMENTS

| | | | |
|---|---|---|---|
| 3,212,561 | 10/1965 | Eckel | 52/829 X |
| 3,402,520 | 9/1968 | Lee et al. | 52/316 X |
| 3,404,502 | 10/1968 | Miller | 52/316 |
| 3,599,703 | 8/1971 | Mennuto | 52/456 X |
| 4,080,756 | 3/1978 | Heaney | 49/501 X |
| 4,635,421 | 1/1987 | Newberg | 52/455 X |
| 5,022,206 | 6/1991 | Schield et al. | 49/171 X |
| 5,024,023 | 6/1991 | Kostos et al. | 49/501 |
| 5,077,948 | 1/1992 | Olson et al. | 52/809 X |
| 5,184,423 | 2/1993 | McCarty | 49/501 |

*Primary Examiner*—Lanna Mai
*Attorney, Agent, or Firm*—Pandiscio & Pandiscio

[57] ABSTRACT

A new traffic impact door construction is provided together with a method of making same. The door body comprises an internal frame and front and back door face panels that are ultrasonically bonded to the frame, with the frame being constructed from extruded thermoplastic beam-type frame members. At least one of the frame members serves as a door post mount and other frame members serve as a supporting frame for a window pane. The frame members also are adapted to serve as mounts for flexible and resilient door edge seals.

34 Claims, 7 Drawing Sheets

IMPACT DOOR CONSTRUCTION AND METHOD OF MANUFACTURE

The present invention relates to traffic doors and, more particularly, to a new and improved design and method of constructing traffic doors.

BACKGROUND OF THE INVENTION

Traffic doors are two-way swinging doors commonly used in industrial and commercial establishments. The doors are normally biased to the closed position and can be swung to the open position manually or by impact with material handling equipment, such as fork lift trucks, hand trucks, shopping carts, etc. Conventional commercial plastic traffic doors are used in a variety of retail operations, such as supermarkets, convenience stores, and restaurants.

Traffic doors are well known. For example, U.S. Pat. Nos. 3,979,872 to Gilchrist et al., 3,854,263 to Eckel, and 4,397,117 to Shipp all disclose typical prior art traffic doors. It is necessary to design and manufacture prior art traffic doors with sufficient strength and resiliency to withstand impact during opening. These doors typically consist of an internal framework, two oppositely facing door face panels and internal sound insulation. The manufacturing costs associated with prior art traffic doors have been high because of the impact resistance requirements and the method of assembling the doors.

The assembly of a typical prior art traffic door begins by placing a first rectangular plastic door face panel on a supporting work table, and then adhesively bonding to that door face panel a plurality of rectangular honeycombed struts or frame members so as to form a rectangular framework, with one or more of the frame members being disposed cross-wise so as to subdivide the area encompassed by the framework into two or more compartments. The frame members are usually made of wood or are extruded rubber or plastic parts. This initial series of steps includes the need to prepare the opposite sides of the frame members, and preferably also one surface of the two door face panels, for adhesive bonding of the door face panel to the frame members. This preparation normally includes application of adhesive to both the framework and the two door face panels.

Next baffling inserts comprising a material that can act as a sound-absorbing and/or an impact absorbing medium are placed in the open areas or compartments demarcated by the frame members. By way of example, the inserts may consist of foam rubber, fiberglass or other suitable sound or impact absorbing material.

Thereafter, the second door face panel is placed on and bonded to the framework under mechanical pressure so as to form an integrated door body.

Commercially available impact doors typically have door face panels in the form of sheets of acrylonitrile butadiene styrene polymer (A.B.S.), polyethylene, or polyvinylchloride. In applications where the doors are in close proximity to food or pharmaceuticals, the panels constitute U.S.D.A. and F.D.A.-approved grades of the aforementioned or other like materials.

Often, the doors include a window in the form of an opening that is filled with a pane of transparent material. Usually the panel is secured in place by mechanically fastened means, which may include a surrounding frame. Also a resilient nose or nosing, preferably made of a suitable elastomer such as a synthetic rubber, is attached to one longitudinal side of the door, either before or after the panels and frame members are adhesively bonded together. The nose serves as a compliant edge for the door so that when two such doors are mounted in a doorway, the compliant edges engage one another and function as a seal and also as a door edge protector.

A stile is mounted to the other longitudinal side of the door, opposite the nose. Associated with the stile is an external metal mount which is fastened to the two plastic door panels and serves to secure the stile to the door body. The mount also serves to support a circular pivot shaft. A typical prior art stile is solid and extends the length of the door. Its outer longitudinal edge is shaped to provide a circularly curved groove for receiving the circular pivot shaft. Prior art stiles have been made of wood or aluminum, while usually the pivot shaft is made of steel or aluminum.

Door-pivoting hardware, typically consisting of a lower bearing for the pivot shaft and at least a portion of a door cam assembly, is mounted to the foregoing door assembly to complete the manufacturing process.

In addition the door face panels of prior art traffic impact doors commonly are provided with bumpers and wear panels to provide increased impact resistance and longer door life. The bumpers and wear panels may be made of various materials, e.g., plastic, rubber or metal. Typically bumpers are formed of a stiff plastic (e.g., polyethylene) or a hard rubber sheet material and are surface mounted to the plastic door face panels using mechanical fasteners. Plastic bumpers can be molded in colors to match the color of the door face panel; however an exact color match is difficult or costly to obtain.

Although the above described prior art process yields a door of sufficient strength and resiliency to survive the impact of trucks, carts, etc., it suffers from the fact that it involves extensive use of adhesives which require safe use procedures and substantial curing times, as well as presenting critical disposal problems. Moreover, the process requires a considerable amount of manual labor, resulting in high manufacturing costs. Typically preparing the components for adhesive bonding, the adhesive application, and the adhesive curing aspects of this assembly process take from 12 to 24 hours to complete, with several workers being involved in the process. Likewise, considerable time and labor are required to assemble the stile, metal mount and associated hardware. Manufacture and sale of prior art traffic impact doors of the type described above suffer from still other limitations known to persons skilled in the art. Thus, for example, if the nosing becomes worn or damaged during use, it usually is necessary to replace the entire door. Also the metal mounts are exposed, and this negatively affects the aesthetic character of the doors. To improve the aesthetics, additional plastic sheets may be applied to the outer surfaces of the door to cover the exposed metal external mount. However, this approach involves increased costs and also makes it difficult to produce a single color door.

OBJECTS OF THE INVENTION

A primary object of the present invention is to provide an improved traffic impact door which eliminates or substantially reduces the disadvantages associated with prior art traffic doors and their mode of manufacture.

A more specific object is to provide a traffic door having a frame comprising a plurality of frame members that are bonded to outer door face panels without the necessity of using adhesives or mechanical fastening means.

Another object of the present invention is to provide doors with bumpers and/or wear panels or the like that are integral parts of one-piece outer door face panels.

Still another object of the invention is to provide a traffic door having a door post-supporting stile in the form of an extruded frame member which is assembled in place at the same time as the other door frame components, thus reducing overall manufacturing cost.

Another object of the invention is to provide a traffic door with no or a minimum of metallic fasteners or metallic mounting structures visible on the outer surfaces of the door.

Still another object of the invention is to provide a traffic door having a nose that can be replaced without the need for special tools or service or the replacement or reconstruction of all or a substantial part of the door.

A still further object is to provide a traffic impact door having a molded window aperture section adapted to be provided with one or more panes of a transparent plastic or glass.

Another object is to provide a simplified and relatively inexpensive method of manufacturing traffic impact doors.

Another specific object is to provide a method of assembling a traffic impact door that utilizes plastic door face panels and plastic door frame members and is characterized by use of ultrasonic welding of the face panels to the frame members.

Another specific object is to provide a traffic impact door having vacuum formed structural features.

SUMMARY OF THE PRESENT INVENTION

The foregoing and other objects hereinafter described or rendered obvious are achieved by providing an impact traffic door that comprises a plurality of extruded ultrasonically bondable peripheral frame members arranged to define an internal door frame. In addition, one or more extruded ultrasonically bondable interior cross frame members traverse the interior open space defined by the peripheral frame members so as to subdivide the interior open space into two or more compartments. These frame members are formed of a suitably stiff material so as to provide structural integrity to the door. Outer plastic ultrasonically bondable door face panels are ultrasonically welded to the internal frame, with the compartments defined by the frame members being filled with a suitable energy absorbing material.

In a preferred method, the peripheral frame members are laid out on a flat table or other supporting surface in a pattern determined by the desired shape of the door, with the interior frame members extending transversely between opposite side peripheral frame members. For most door designs, the peripheral frame members are positioned so as to define a rectangular frame. The frame members are aligned and secured in place on the supporting surface by suitable jig or fixturing means according to techniques well known to persons skilled in the art.

Then the frame is ultrasonically bonded to the two opposing outer plastic door face panels in two steps.

The first step involves placing a first plastic door face panel over and in engaging relationship with the exposed side of the frame members on the supporting table. This first panel is then ultrasonically welded to the frame, both along its periphery and its interior, at selected intervals, e.g., intervals of approximately one to six inches. The resulting ultrasonically welded sub-assembly is then rotated 180 degrees about one of its two mutually orthogonal axes so as to re-expose the frame, and then repositioned on the flat supporting surface so that the first panel rests on that supporting surface. At this point there is no need for any jigs or fixtures to hold the frame members together since the first panel is now securely fastened to the several frame members, with the latter forming a rectangular frame with the one or more interior frame members (the cross-wise extending frame members) acting to subdivide the area defined by the exposed surface of the first door face panel and the peripheral frame members into two or more compartments. Thereafter these two or more compartments are filled with a suitable energy-absorbing material for deadening shocks and/or sound in the finished door. The second ultrasonic bonding step involves placing a second outer plastic door face panel over the exposed upper side of the frame and then ultrasonically welding that panel to the frame members.

The ultrasonic welding is accomplished using conventional ultrasonic welding equipment, such as the equipment sold by Branson Industries, Inc. of Stamford, Connecticut. Further by way of explanation, attention is drawn to U.S. Pat. Nos. 3,367,809, 3,499,808, 4,016,436, 4,326,903 and 4,750,955 that show use of an ultrasonic head or transducer for facilitating ultrasonic welding of thermoplastic materials. The welding may be accomplished by a hand-held ultrasonic welding head. Alternatively, the welding is accomplished by means of large ultrasonic welding apparatus of the type comprising an X-Y supporting table for hold the work to be welded, and an ultrasonic welding head that is operated in synchronism with X-Y movement of the X-Y supporting table. As used herein, the term "X-Y supporting table" means a table that (1) is mounted for reciprocal movement along two mutually orthogonal axes, the "X" and "Y" axes, and (2) is coupled to means for causing the table to translate along both of those axes according to a predetermined program of movement. In this connection it is to be appreciated that alternatively the table may be fixed and the ultrasonic welding head may be mounted to an X-Y translating mechanism that is adapted to cause the welding head to move along "X" and "Y" axes corresponding to the longitudinal and transverse axes of the table. The "X" and "Y" relative movement of the ultrasonic welding head and the table allows the same head to be used to accomplish all of the welding.

The frame members of the present invention are elongate beams with a polygonal, preferably rectangular, cross-section. The frame members may be solid, but preferably they are hollow. These frame members are formed of an extruded, ultrasonically bondable, thermoplastic material, for example polyvinyl chloride or ABS. Advantageously, the individual frame members may or may not be bonded to each other prior to being welded to a door face panel.

To facilitate ultrasonic welding of the frame members to the outer plastic panels of the present invention, at least one and preferably at least two or three ultrasonic energy concentrating strips are provided on two opposite surfaces of the frame members. Preferably the energy strips are inverted "V" shaped solid ridges or ribs molded as part of the frame members. In this case it is preferred that they run the full length of each frame member. They provide an initial contact point between the frame member and a plastic door face panel. When the ultrasonic welding head is energized, the energy strips act to focus the ultrasonic energy at the point where they engage the overlying panel of ultrasonically bondable plastic material.

As a further optional feature of the invention, the door face panels may be vacuum formed to provide desired surface features. For example, a plurality of bulbous projections may be vacuum formed in the panel so as to serve as bumpers. These bulbous projections may be formed as elongate elements that extend parallel to the vertical or horizontal axis of the door. The projections also may have other shapes, e.g., box-like or hemi-spherical shapes. Likewise logos, signs, indicia, etc., may also be vacuum formed into the panels.

In a preferred embodiment of the present invention, four peripheral frame members form a rectangular frame, with a first one of the peripheral frame members constituting both a frame member and a stile/door post mount, and a second one of the peripheral frame members constituting both a frame member and a curved door nosing. These particular frame members are located along and form opposite sides of the rectangular frame, with the stile/mount portion and the curved door nosing portion projecting outwardly beyond the edges of the door face panels. In this preferred embodiment, the ends of the four peripheral frame members are mitered so that the assembled door frame will have right angled corners. Preferably at least the aforesaid first and second peripheral frame members are adapted to accommodate resilient seal members.

In another embodiment of the invention, one or more resilient seal members are removably attached to peripheral frame members.

The present invention involves provision of apertures in the plastic door face panels that define a window opening, with at least one transparent window pane being mounted to the door so as to extend across the full expanse of the window opening. In another embodiment the panels are vacuum formed so that the apertures are offset from the plane of the panels, and one of the apertures is larger than the other so as to provide a peripheral edge portion that serves as a supporting shoulder for the window pane.

Other features are described or rendered obvious by the following detailed description.

GENERAL DESCRIPTION OF THE DRAWINGS

For a fuller understanding of the nature and objects of the present invention, reference should be had to the following description taken in connection with the accompanying drawings wherein.

DETAILED DESCRIPTION OF THE INVENTION

Ultrasonic bonding of plastic parts is well known. For example, U.S. Pat. Nos. 3,367,809 to Soloff, 3,488,240 to Roberts, 3,499,808 to Obeda, 3,717,539 to Roberts, 3,966,520 to Fallenbeck et al., 4,016,436 to Shoh, 4,326,903 to Summo; 4,352,711 Toth, 4,508,581 to Rohringer, 4,478,659 to Hall, 4,750,970 to Malosh, and 4,906,510 to Todor Jr. et al., all disclose various methods and devices for ultrasonically bonding plastic parts.

Accordingly, it is not believed necessary to describe and illustrate in detail any of the ultrasonic welding apparatus that is used in the practice of this invention.

Figure 1:
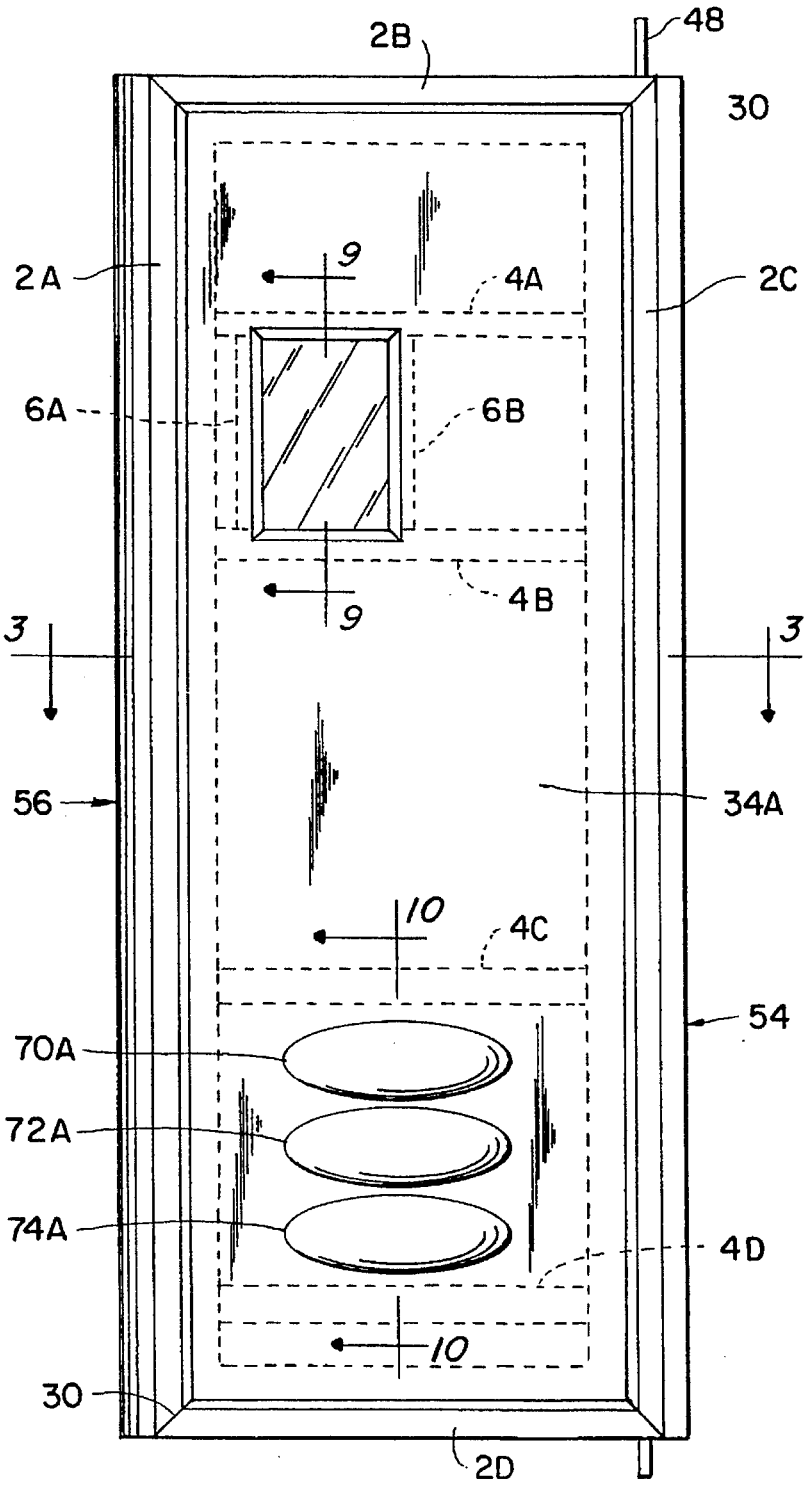
FIG. 1 is a front view in elevation of a preferred embodiment of the invention.
Figure 3:
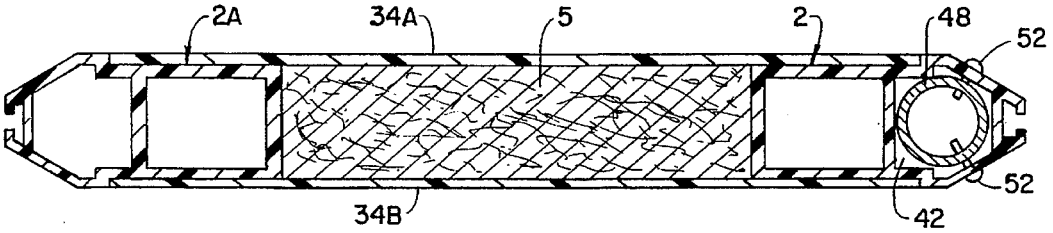
FIG. 3 is a cross-sectional view of the door taken along line 3—3 in FIG. 1.
Figure 2:
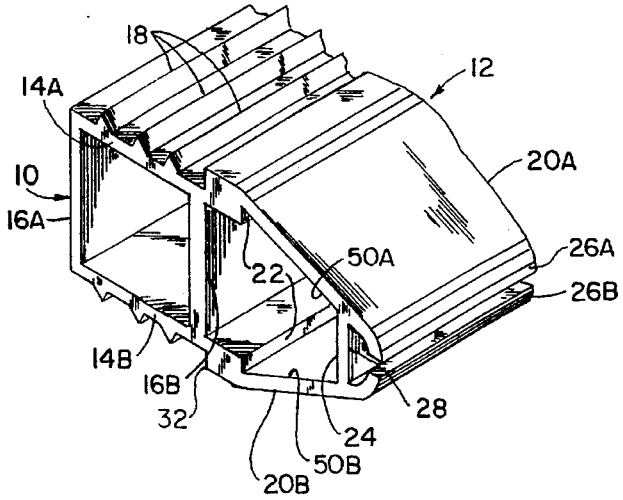
FIG. 2 is a perspective view of a peripheral frame member.

Referring first to FIGS. 1–4 and 10, it is to be appreciated that it does not disclose the cam and bearing hardware for mounting the door, except that it includes a pivot post hereinafter identified. The illustrated door body comprises a rectangular frame which is made up of four extruded, peripheral frame members 2 A–D and a plurality of interior frame members 4A, 4B, 4C and 4D that act as cross braces for the panels and subdivide the interior space of the frame into several compartments which preferably are filled with energy absorbing material as shown at 5 in FIG. 3. In addition, two relatively short extruded strut members 6A and 6B coact with the cross or interior frame members 4A and 4B to define a window frame opening. Referring now specifically to FIGS. 2 and 3, the peripheral frame members 2A–2D are identical in cross-sectional shape. These peripheral frame members are plastic extrusions which preferably are made of polyvinyl chloride (PVC), but also may be made of some other suitable plastic such as ABS. These extruded frame members comprise a rectangular box section identified generally at 10 and a tapered nose section identified generally at 12. Each box section consists of two opposite flat walls 14A and 14B which are connected by two parallel webs 16A and 16B. Preferably, but not necessarily, the thickness of walls 14A and 14B, and webs 16A and 16B, are substantially identical. The two walls 14A and 14B are each provided with a plurality of parallel raised ribs 18 that function as ultrasonic energy-concentrating strips. These energy strips 18 are designed to concentrate ultrasonic energy to facilitate welding of the frame members to the outer panels of the door. Preferably, these strips 18 have a triangular shape as shown. These strips or ribs extend lengthwise of the peripheral frame members, preferably for the full length of each such frame member.

Still referring to FIG. 2, the nose section 12 of peripheral frame members 2A–D comprises a pair of opposite side walls 20A and 20B which are formed integral with the side walls 14A and 14B. In this connection, it is to be noted that the side walls 14A and 14B project beyond the web 16B so as to form right-hand shoulders 22 with the side walls 20A and 20B. The side walls 20A and 20B converge on one another outwardly of the strut 16B and are connected by a longitudinally extending web section 24. Additionally, the side walls 20A and 20B of the nose section have end extensions 26A and 26B which are spaced from one another and are molded so as to define a T-shaped slot 28 that runs the length of each of the peripheral frame members 2A–2D.

The peripheral frame members 2A–2D are arranged in a rectangular configuration by mitering their opposite ends so as to form right angle corners, as demonstrated at 30 in FIG. 1.

Still referring to FIG. 2, the side walls 20A and 20B of nose section 12 are formed with inner end surfaces 32 that extend parallel to the plane of webs 16A, 16B and at a right angle to walls 14A, 14B. The perpendicular surfaces 32 coact with the upper and lower surfaces of walls 14A and 14B to define a rectangular depression sized to receive one of the two opposite rectangular face panels 34A, 34B. Only the panel 34A is visible in FIG. 1, but it is to be understood that the opposite side of the door has essentially the same appearance as the side that is visible in FIG. 1. The face panels 34A and 34B are made of a suitable plastic sheet material which is capable of being ultrasonically bonded. Preferably, the face sheets are made of a plastic material such as PVC or ABS. In this connection it is to be noted that the hardness and hence the stiffness of panels 34A and 34B may be the same as or different from the hardness and stiffness or the peripheral frame members 2A–2D, and the internal frame members 4A–4D and 6B. The face panels 34A and 34B may be molded so as to have ultrasonic energy strips similar to those provide on the peripheral frame members. Preferably, however, in the interest of cost and simplicity, the panel members 34A and 34B are made of flat sheet material without any attempt to provide them with energy strips. The door face panels are ultrasonically bonded to the peripheral frame members and also to the interior frame members.

Figure 4:
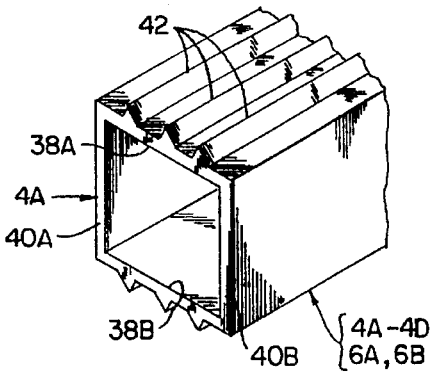
FIG. 4 is a peripheral view of an internal frame member.

In this preferred embodiment, all of the interior frame members are of identical cross-section and differ only in their lengths according to their purposes. As seen in FIGS. 3 and 4, each interior frame member has a pair of flat side walls 38A and 38B connected by a pair of connecting struts or webs 40A and 40B. The side walls 38A and 38B are provided with raised ribs 42 that function as energy strips and preferably are identical to the energy strips 18 of the peripheral frame members.

In the preferred embodiment of the invention, the peripheral frame members 2A–2D do not necessarily contact and also have no direct connection to one another. Similarly, the interior frame members do not necessarily contact and also have no direct connection to one another. Additionally, the interior frame members do not necessarily contact and also have no direct connection to the peripheral frame members. However, during the assembly of the door body shown in FIG. 1, the opposite face panels 34A and 34B are bonded to the peripheral and internal frame members and thus act to connect those frame members so as to form an integrated frame. However, as explained hereinafter, provision may be made for providing a temporary anchor or locating means for determining the positions of the peripheral frame members 2A–2D and also the interior window framing members 4A–4D and 6A and 6B.

Referring again to FIGS. 1–3 and 5, the nose section 12 is shaped so that its interior defines a chamber 42 for receiving a hollow door post or pivot shaft 48. The door post 48 may be a solid rod of circular cross-section, but preferably it is a cylindrical tube made of steel or aluminum. Chamber 42 is sized so that the interior corners formed by the surfaces 22 coact with the relatively flat interior surfaces 50A and 50B of walls 20A, 20B of nose section 12 to define a four point contact, or a near four point contact, with pivot shaft 48. Therefore, the nose section 12, when it is used to accommodate the pivot shaft 48, may be deemed to be a pivot shaft mount, while the box section 100 coacts with the nose section to serve as a stile/frame member. The pivot shaft is secured to the nose section 12 by means of a plurality of metal fasteners 52 which are inserted through the side walls of the nose section and the door post. The fasteners 52 may be machine screws, in which case the pivot shaft 48 would be provided with threaded holes. Alternatively, the fasteners 52 may be a common form of pop rivet.

With reference to FIG. 3, it is anticipated that chamber 42 may be oversized with respect to door post 48, in which case an elongate shim plate (not shown) may be inserted between the shaft and web 16B to force the shaft into tight engagement with the inner surfaces 50A, 50B.

Figure 6:
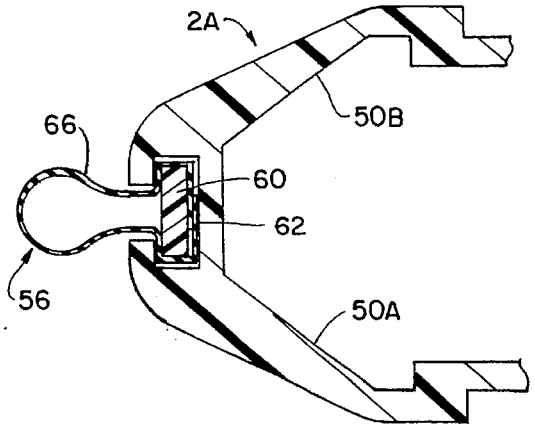
FIGS. 5 and 6 are enlarged cross-sectional views of two of the peripheral frame members.
Figure 5:
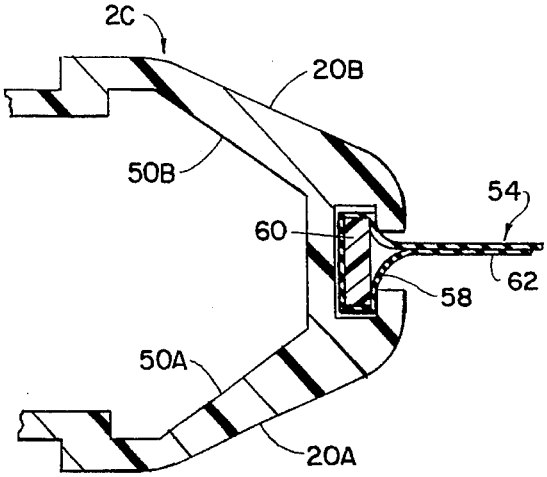

Referring now to FIGS. 5 and 6, the purpose of the T-shaped slots 28 is to accommodate a resilient air seal which may take several forms. In FIGS. 5 and 6, elongate strips of a resilient sheet material are employed to form a blade or lip-type seal 54 and a bulbous nose seal 56. The resilient sheet material that is employed for the air seals may be a rubberized fabric or it may be a strip of an extruded rubber or an elastomer or pseudo-elastomeric plastic, e.g., a thin sheet of a silicone or butyl rubber, polyethylene or ABS. In the version shown in FIG. 5, the blade seal 54 comprises an elongate strip of resilient sheet material 58 that is wrapped around a relatively stiff and hard insert strip 60 made of metal or a plastic material. The resilient sheet material 58 is disposed about the inserted retaining strip 60 so that its opposite edges are in confronting relation with one another outside the peripheral frame member. In this embodiment the ends of the resilient sheet material are bonded to one another so as to form a relatively thick lip-type or blade-type seal. In FIGS. 5 and 6, the size of the insert strip is shown undersized solely for purposes of illustration. In practice, the insert strip 60 is made large enough so that it and the seal material 58 make a tight fit in the T-shaped groove 28. The blade or lip seal shown in FIG. 5 can be formed by (1) folding over an elongate strip of the desired material and adhesively securing or otherwise bonding the longitudinally extending edges thereof so as to form a dual ply blade section 62, with the remainder of the material then defining a flexible hollow tube section, which is then inserted into the T-shaped slot in position to receive retaining strip 60, whereby the hollow section is anchored to the peripheral frame member.

In the version shown in FIG. 6, the longitudinal edges of the single strip of resilient seal material 58 are folded over one another between the retaining strip 60 and the adjacent wall of the peripheral frame member, resulting in a bulbous nose section 66 which protrudes from the door body. In this case it is preferred, but not necessary, for the overlapping edges of the strip 58 to be pre-bonded to one another, in which case a resilient tube is formed that is inserted into slot 28 and secured in place by strip 60 which presses part of the flexible tube tight against the sides of the T-shaped slot. It is preferred that a blade type seal 54 be attached to the peripheral frame member 2C that has the pivot post 48, and a bulbous type seal 56 be attached to the opposite longitudinally extending peripheral frame member 6A. In the case where two of the doors shown in FIG. 1 are mounted in a door opening as is the usual custom, the seal of FIG. 6 is disposed to mate with the corresponding nose seal in the second door to prevent flow of air between the mutually confronting edges of the two doors when they are in closed position. In the case where a single door is mounted in a door frame, the bulbous seal of FIG. 6 may be dimensioned so that it will engage the door jamb when the door is in its normal at-rest center position. The blade seal of FIG. 5 is made to extend out enough to engage the adjacent door jamb.

Figure 9:
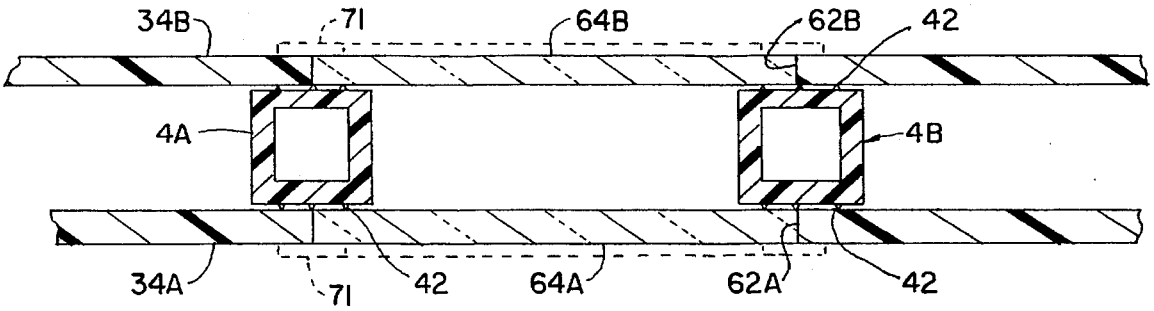
FIG. 9 is a cross-sectional view taken along line 9—9 of FIG. 1.

Referring now to FIGS. 1 and 9, the opposite door face panels 34A and 34B are provided with rectangular apertures 62A and 62B respectively which are of identical size and are aligned with one another. The interior frame members 4A, 4B, 6A and 6B are disposed so as to define an opening which is somewhat smaller than the apertures 62A, 62B, with the result that when the face panels 34A, 34B are bonded to the frame members, portions of the frame member 4A, 4B, 6A and 6B are visible along the borders of the apertures 62A and 62B. Window panes 64A, 64B, which are made of a transparent impact resistant, ultrasonically-bondable thermoplastic material such as Lucite or Plexiglass, are attached to the door. As seen in FIG. 9, the window panes 64A and 64B are sized so as to make a snug fit in the apertures 62A and 62B. Since the window panes are ultrasonically bondable, no exterior retaining members are required for holding the window panes in place. Instead the window panes overlap and engage one or more of the energy strips 42 on the frame members 4A, 4B, 6A and 6B and are ultrasonically bonded to the window frame defined by those interior frame members.

Figure 10:
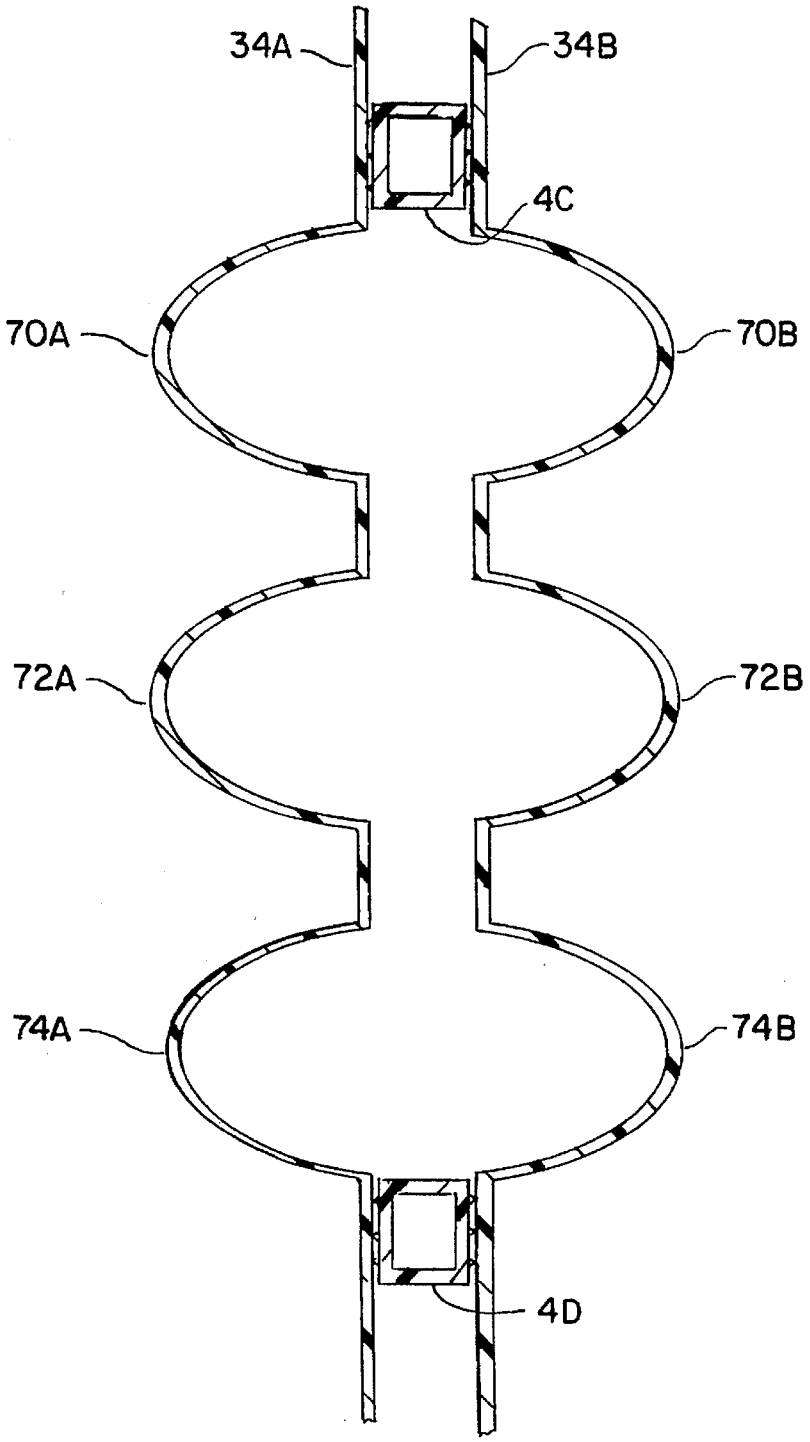
FIG 10 is a cross-sectional view taken along line 10—10 of FIG. 1.

Referring now to FIGS. 1 and 10, an advantage of the invention is that the door face panels 34A and 34B may be vacuum formed to provide projecting sections which can act as bumpers or wear plates. In the door illustrated in FIGS. 1 and 10, the door face panels 34A, 34B are molded by a vacuum forming process so as to provide contoured protuberances adapted to function as bumpers. In the illustrated embodiment, each of the panel 34A and 34B is provided with three elongate protuberances that have a generally elliptically curved contour in cross-section. The three parallel protuberances 70A, 72A, 74A in the front door panel 34A are identical to and are positioned in alignment with like protuberances 70B, 72B in the door panel 34B. As seen in FIGS. 1 and 9, interior frame members 4C and 4D may be provided to add stiffness to the door above and below the region of the molded protuberances 70A–74B. If necessary, the door structure may be augmented by providing additional vertically extending interior frame members (not shown) between the members 4C and 4D at the opposite end of the protuberances 66A–70B.

Another advantage of using panels made of thermoplastic sheet material is that the sheets may be embossed by vacuum forming with various indicia, e.g., a warning sign that will withstand the impacts to which the doors are regularly subjected.

The following is a description of how the above-describes door is assembled to form a unitary door body. First of all, the frame members 2A–2D and the interior frame members 4A–4D, 6A and 6B are placed on a flat supporting table in the configuration shown in FIG. 1. The supporting table may be provided with fixtures for releasably holding the components in place so as to attain the desired rectangular configuration. Then one of the door face panels, e.g., the face panel 34A, is placed over the frame members so that the panel is resting on the raised energy strips 18 of the peripheral members and also the raised energy strips 42 of the interior frame members with the edges of the panel engaging or nearly engaging the surfaces 32.

At this point it is to be noted that preferably the window apertures 62A, 62B are preformed in door face panels 34A, 34B. Alternatively, the apertures 62A, 62B may be formed by cutting out portions of face panels 34A, 34B immediately after each panel has been bonded to the door frame members.

Thereafter, an ultrasonic welding head is engaged with door panel 34A to ultrasonically weld it to the underlying frame members. Preferably, the welding head is operated so that it is moved both vertically and horizontally along the entire expanse of the panel, with the ultrasonic head being stepped along the X and Y axes by relatively small amounts, e.g., 2 to 6 inches, so as to weld successive portions of the panel to the underlying frame members. The ultrasonic welding may be accomplished by a hand-held welding head as described above, but preferably the ultrasonic welding head forms part of an X-Y apparatus consisting of a work-supporting table and an ultrasonic welding head, with means for moving along X and Y axes (conforming to vertical and longitudinal axes of the door as viewed in FIG. 1) by predetermined increments so as to cause spot welding of the panel to the underlying frame members. Then the resulting subassembly consisting of the peripheral and interior frame members welded to the panel 34A is lifted off of the supporting table and turned over so that now the panel 34A rests on the supporting table.

Next, the several compartments defined by the peripheral and interior frame members are filled with sound absorbing material 5, e.g., bats of fiberglass wool.

After insulation material 5 has been installed as described, the second face panel 34B is placed over the exposed frame member so as to conceal the insulation. The right angle surfaces 32 of the peripheral members automatically locates the panel 34B so that its aperture 62B is aligned with the aperture 62A of the opposite panel 34A. Then the second panel 34B is ultrasonically welded to the peripheral and interior frame members using the same procedure as for the first door face panel 34A. At this point the door body constitutes an integrated structure, with the frame members being secured to one another by virtue of their connection to the front and rear face panels 34A and 34B, and the interior space between the panels defined by the frame members being filled with insulating material.

Thereafter, the pivot post, seals and the window panes are attached to the door body. The order of installing the post, the seals and the window pane is not critical, and so these installation steps may be accomplished in any preferred order.

Installation of pivot post 48 involves inserting the post into the cavity 42 defined by the nose section of the peripheral frame member 2C and securing it in place with fasteners 52. If necessary, a shim (not shown) is inserted between the pivot shaft and the interior wall 16B of the peripheral frame member 2C to make certain that the post engages the corners formed by the shoulders 22 and also the two converging inner surfaces 50A, 50B of the nose section as shown in FIG. 3.

Figure 7:
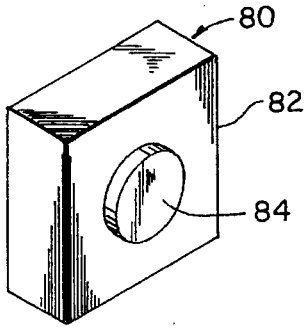
FIG. 7 is a perspective view of a plug member.

Preferably, as noted above, a blade or lip type seal 54 is mounted to the nose section of the frame member that is mounted to the door post 48, while a bulbous nose type seal is mounted to the nose section of the opposite peripheral frame member 2A in the manner shown in FIG. 7. It is to be noted that seals may also be attached to the upper and lower peripheral frame members 2B and 2D in the same manner as seals are attached to the frame members 2A and 2C. However, no seals are on the upper and lower ends of the door shown in FIG. 1.

Preferably, the window panes 64A, 64B are sized to make a close fit in the apertures 62A, 62B. They are inserted against the exposed portions of frame members 4A, 4B, 6A and 6B as previously described, and then an ultrasonic welding head is used to ultrasonically bond the window panes 64A and 64B in place. It is to be noted that if a slight crevice or gap exists between the window panes and the surfaces defining apertures 62A, 62B, a suitable transparent or colored filler material may be inserted in the gaps. Alternatively, if desired, an auxiliary rectangular window frame may be attached to panels 34A and 34B as shown in phantom at 70 in FIG. 8. These auxiliary frames may be secured in place by fasteners or by a suitable adhesive, or even may be ultrasonically bonded to face panels 34A, 34B.

After the door body has been assembled in the manner described above, it is ready for installation using standard cam and bearing hardware of the type disclosed in U.S. Pat. Nos. 4,124,955, 4292764 and 4,951,351.

OTHER EMBODIMENTS OF THE INVENTION

Figure 8:
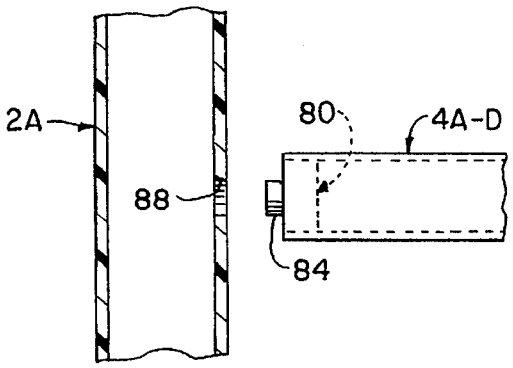
FIG. 8 is a fragmentary sectional view showing how the plug member is used.

Turning now to FIGS. 7 and 8, a possible modification of the invention involves the provision of a plurality of plug elements 80 each consisting of a rectangular body 82 having a circular projection 84 that serves as a locating pin. As shown in FIG. 8, plugs 80 are sized to be inserted into the opposite ends of cross members 4A–4D. The plug may be sized so as to make a tight compression fit in the end of the cross members. Alternatively, the plug may be cemented in place. When plugs 80 are used, the adjacent sides of peripheral frame members 2A and 2C are provided with a round hole 88 that is sized to make a close fit with the pin 84. In this way, the plug 80 serves as a locating means for the cross members so as to assure that the cross members are aligned at right angles to the peripheral frame members 2A and 2C. Although the pin 84 may be cemented in place in the side frame member 2A and 2C, it is preferred that the pin simply make a close enough fit to serve as a locating element. Of course, if desired, the plugs 80 may be provided with energy concentrating ribs on one or more of their four peripheral surfaces so as to facilitate welding them to the interior cross frame member 4A–4D in which they are installed. The interior frame members 6A and 6B may be located in the same way.

Figure 11:
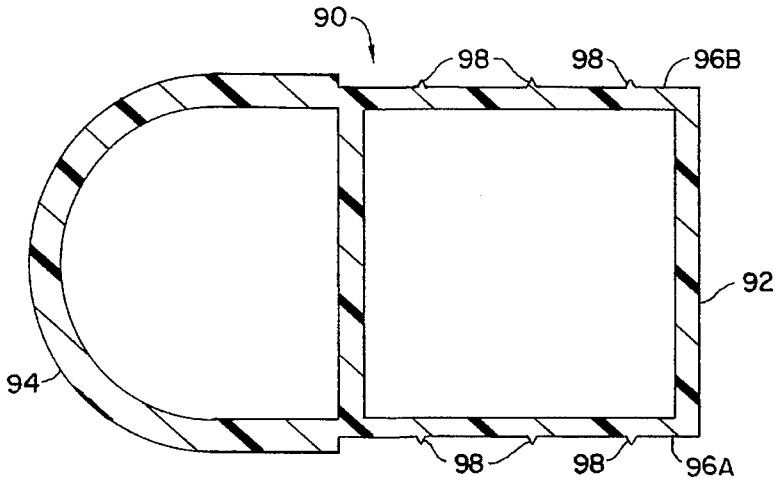
FIG. 11 is a cross-section of another form of frame member.

FIG. 11 shows another modification of the invention. In this case the peripheral frame member 2A is replaced by a frame member 90. In this case the frame member consists of a rectangular box-like section 92 and a rounded nose section 94 that preferably has a circular curvature at its outer end. The box section has recessed surfaces 96A and 96B which are recessed sufficient to accommodate the thickness of door panels 34A and 34B. However, in this modification, the frame member 90 is formed of a resilient plastic material that is softer and hence less stiff than the other frame members 2B–2D. The recessed surfaces 96A and 96B are provided with raised ribs 98 that function as ultrasonic energy concentrating strips and are used to facilitate ultrasonic bonding of the panels 34A and 34B to frame member 90. The durometer of the frame member 90 is adjusted so that when nose section 94 encounters the corresponding nose section on an adjacent door in the case where two swinging doors are mounted in a common doorway, the nose section can yield enough to allow it to swing past the other door.

Figure 12:
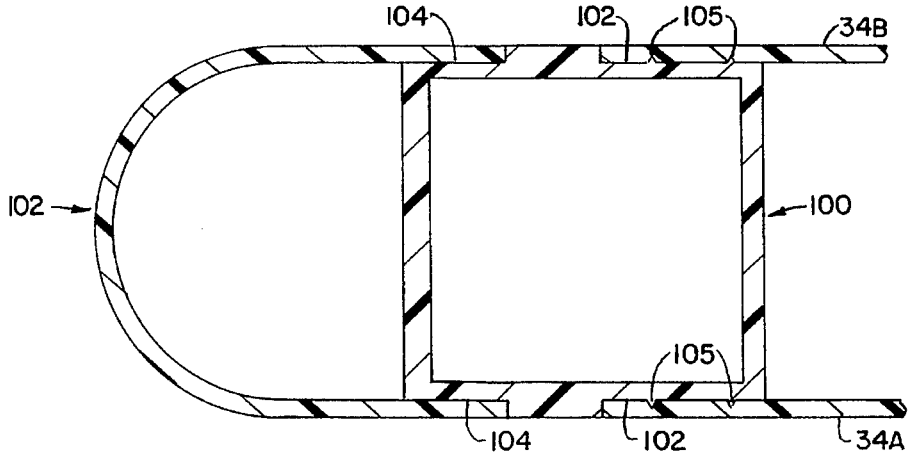
FIG. 12 is a cross-sectional view of an alternative frame member with a separate nose member attached thereto.

FIG. 12 illustrates a further modification of the invention related to the embodiment shown in FIG. 11. In this case, the side frame member 2A is replaced by a two piece assembly consisting of a hollow extruded member 100 of rectangular cross-section and a curved nose member 102 which may be extruded or molded in the shape shown in the figure or which may be formed as a flat sheet material and then bent into the shape shown in FIG. 12 when it is attached to member 100. By way of example, the box section 100 may be made of a relatively stiff ABS material, while the nose member 102 may be made of a flexible and resilient impregnated and coated fabric or a thermoplastic sheet material. The box-like member 100 is formed with recessed surfaces 102 and 104 on two of its opposite sides sized to receive the end edge portions of panel members 34A, 34B and the nose section 102. Preferably, surfaces 102 and 104 are recessed enough to permit flush joints of the nose section and the panels with member 100 as shown. In the case where nose member 102 is formed of an ultrasonically bondable material, the surfaces 104 may be provided with energy concentrating strips (not shown) to facilitate ultrasonic bonding of the nose member 102 to the box member 100. Box member 100 is provided with energy concentrating strips 105 for use in bonding the door face panels 34A and 34B to its opposite side walls.

Figure 13:
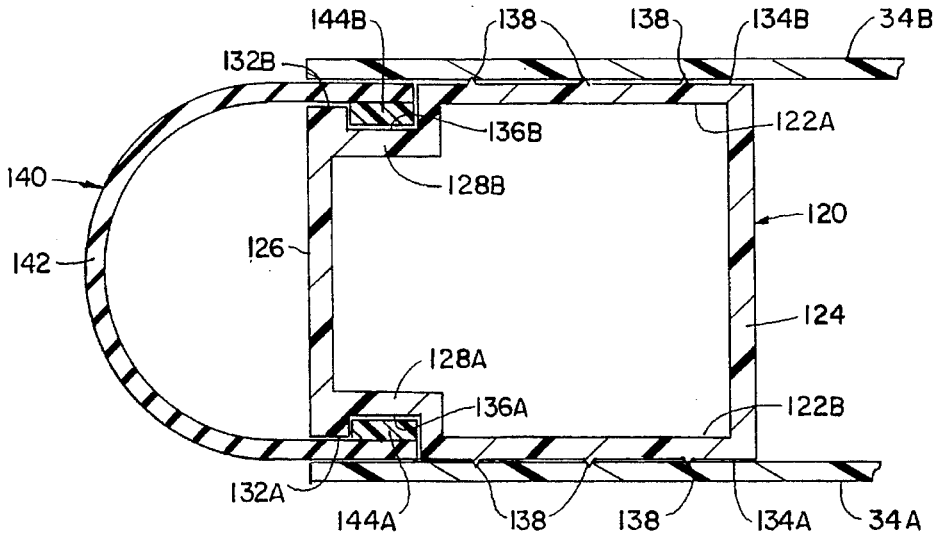
FIG. 13 is a cross-sectional view showing a replaceable door nosing.

FIG. 13 shows still another modification of the invention where the peripheral side frame member 2A is replaced by an extruded peripheral frame member 120. The latter comprises a major body section having opposite side walls 122A and 122B, an end wall 124, and a reduced side extension 126 having a pair of parallel longitudinally extending walls 128A and 128B. The outer surfaces 130A, 130B of side walls 128, 128B, are recessed in relation to the outer surfaces 134A and 134B of the main body section of frame member 120. Surfaces 130A, 130B are formed with matching grooves 136A, 136B of rectangular cross-section. The outer surfaces 134A and 134B are provided with energy strips 138 for use in ultrasonically welding the door face panels 34A and 34B to the frame member 120.

The embodiment of FIG. 13 also includes a removable nose member 140 which consists of a circularly curved section 142 having ribs 144A and 144B at its opposite edges. Ribs 144A and 144B are sized to make a snug, relatively tight slip fit in grooves 136A and 136B. The ribs 144A and 144B may be formed as integral parts of the nose member 140. Alternatively, these ribs may constitute separate strips of relatively stiff material that are bonded to the curved nose section 142. In the latter case, the nose section 142 may be made of a relatively soft pliable low durometer resilient material such as a synthetic rubber, and the rib sections 144A and 144B may be made of the same material or alternatively of a relatively stiff and hard material such as a high durometer rubber or a relatively hard plastic material such as ABS.

The embodiment of FIG. 13 is advantageous in that the nose member 140 is not welded or otherwise bonded to the frame member 120 or to the face sheets 34A and 34B. Instead the relatively tight fit afforded by the interaction of the ribs 144A and 144B with the grooves 136A and 136B assures that the nose section will not move longitudinally, i.e., perpendicular to the plane of the drawing of FIG. 12 under gravity alone, yet it can be pulled lengthwise out of the grooves when it is worn or damaged and needs to be replaced with a new like nose member. The nose section 140 extends for the full length of the door body. Consequently, should ribs 144A, B not make a tight fit in grooves 136A and B, a retaining plate (not shown) may be attached to the lower end of extension 126 so as to support the nose member 140 and thereby prevent it from coming out from the bottom ends of grooves 136, B.

Figure 14:
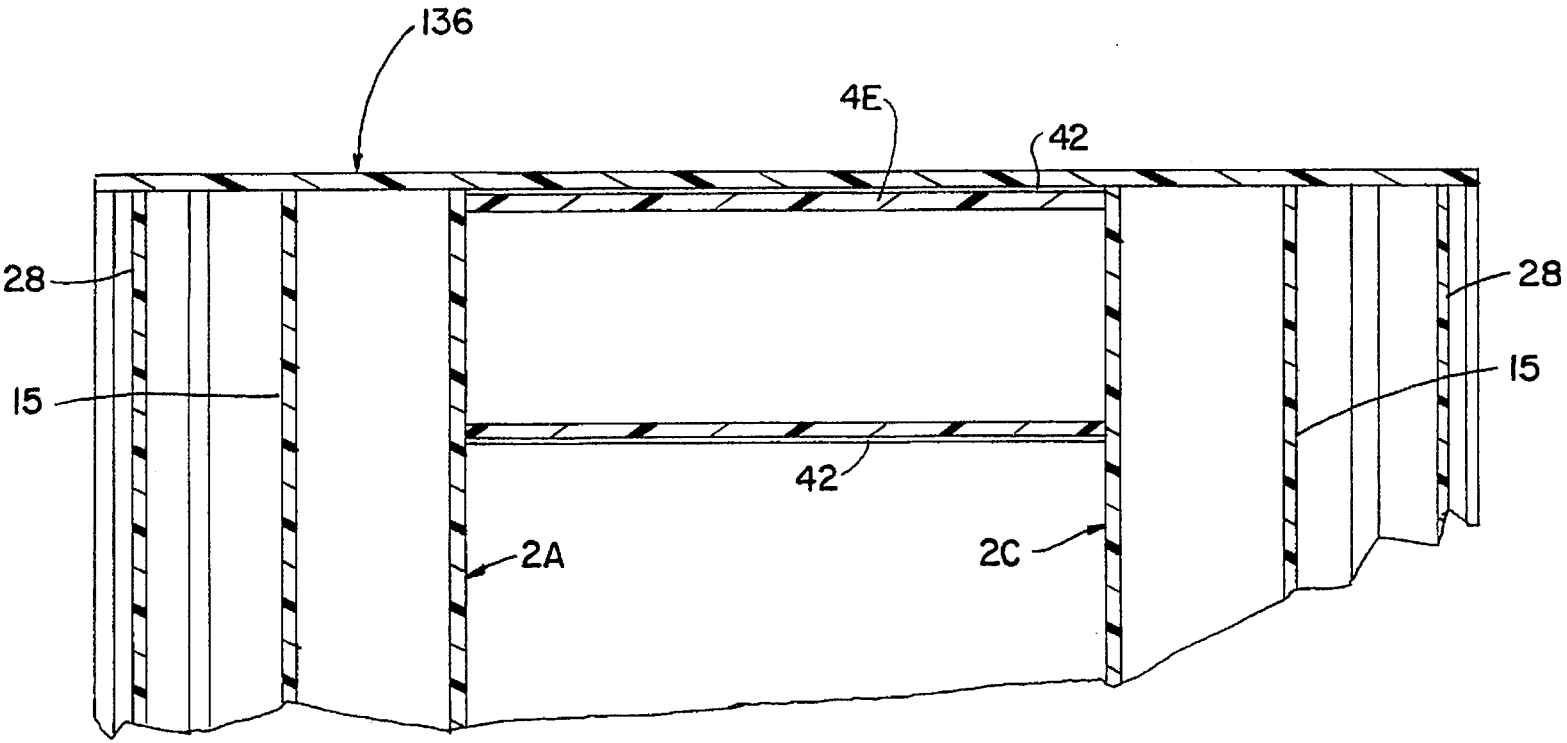
FIG. 14 illustrates an alternative form of interior frame arrangement.

FIG. 14 shows a further modification of the door of FIG. 1. In this case, the side frame members 2A and 2C are exactly the same as the side frame members shown in FIG. 1. However, in this case the upper and lower frame members are box-like frame members corresponding to the interior frame member 4A–4D. FIG. 14 illustrates only the upper end of the door body, but it is to be understood that bottom end of the door would have the same construction as that shown. In this case the box-like top cross member 4E is identical in cross-sectional shape and size to cross members 4A–4D. Frame member 4E may be coupled to frame members 2A and 2C by a plug arrangement like that illustrated in FIGS. 7 and 8. Alternatively, the interior frame member 4E may contact, but not be bonded to peripheral frame members 2A and 2C. The interior frame member 4E is arranged so that one of its two surfaces having the energy concentrating strips 42 faces upwardly. The upper end of the door is closed off by a flat strip 136 which in plan view has a periphery conforming in shape to the outer configuration of the door body cross-section shown in FIG. 3. The cap member 136 may be stamped out of material identical to the material forming the door face panels 34A and 34B. It is ultrasonically bonded to the cross frame member 4E and preferably it also may be secured to the upper ends of the frame members 2A and 2C by an adhesive. Alternatively, the cap member 136 may be provided with ultrasonic energy-concentrating strips which run along its margin and allow it to be ultrasonically bonded to the upper edge surfaces of the members 2A and 2C.

Figure 15:
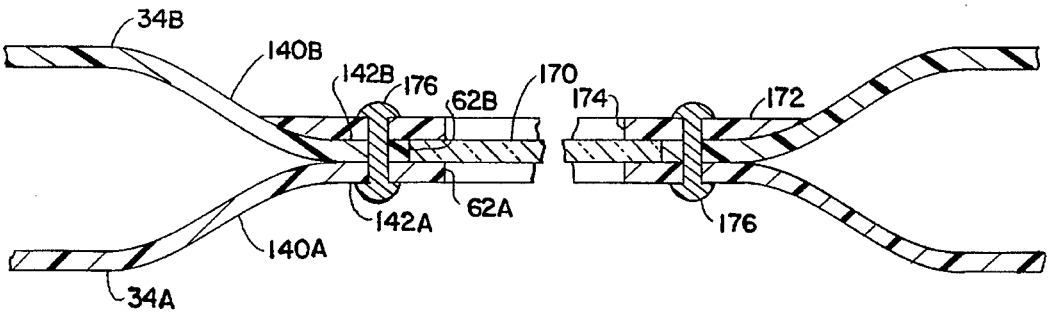
FIGS. 15–17 show different arrangements for mounting window panes in the door bodies.
Figure 16:
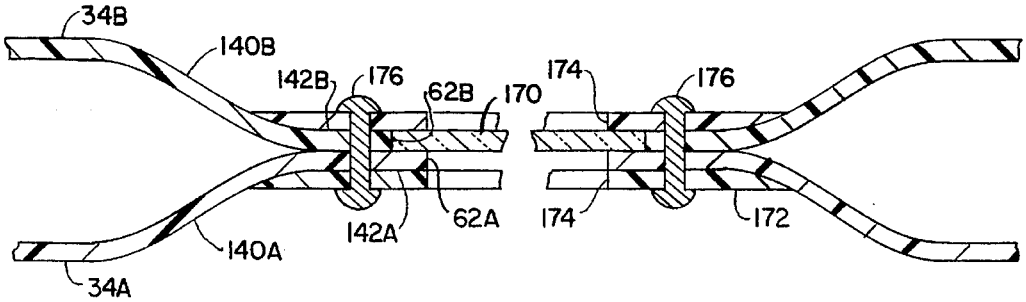
Figure 17:
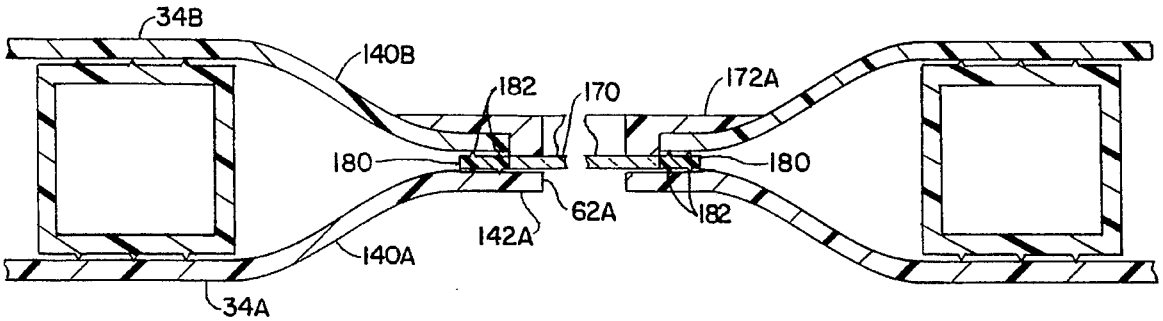

FIGS. 15–17 relate to alternative arrangements for providing a view window in the door. In FIG. 15, the door panels 34A and 34B are vacuum formed so as to have inwardly curved portions 140A and 140B and flat offset portions 142A and 142B. The sections 142A and 142B have rectangular window openings 62A, 62B. However, in this case, aperture 62A is smaller than aperture 62B, with the result that the offset portion 142A of panel 34A overlaps offset portion 142B so as to provide a shelf or shoulder to support a single window pane 170. In this case it is not necessary that the window pane be made of an ultrasonically bondable material and hence it may be made of glass or a synthetic plastic that is not ultrasonically bondable. Window pane 170 is secured in place in the aperture 62B by means of a rectangular clamping frame 172 which has an inner side shaped to conform to the contour of curved portion 140B and has an inner edge 174 that defines a rectangular hole that is aligned with aperture 62A of the panel 34A but overlaps the window pane at its side edges as shown. Frame member 172 is secured to the door face panel 34B by means of metal fasteners 176. The latter may take various forms, e.g., screws and nuts, or pop rivets.

FIG. 16 shows an arrangement like FIG. 14 except that a second frame member 172 is mounted to the panel 34A so that both sides of the door body have an identical appearance.

FIG. 17 shows still another single pane window arrangement. In this case, the panels 34A and 34B are vacuum-formed with offset sections similar to what is shown in FIGS. 14, 15. However, in this case a plurality of flat and straight ultrasonic bonding inserts 180 are disposed so as to form a rectangular arrangement about the aperture 62A in face panel 34A so as to surround window pane 170. Inserts 180 are formed with ultrasonic energy strips or ribs 182 on opposite sides thereof in confronting relation with the adjacent inner surfaces of the door face panels 34A and 34B. An auxiliary mounting frame 172A is disposed over the window pane 170. This frame 172A may be secured to the panel 34B by an adhesive or ultrasonic bonding. In the latter case, the surface of the frame member 172A that engages the outer surface of the door face panel 34B may be provided with energy strips similar to the energy strips 182, so as to facilitate ultrasonic bonding to face panel 34B.

The foregoing description indicates that the present invention provides numerous advantages over the prior art. The foremost advantage of the invention is that it simplifies the door assembly procedure and thereby reduces the cost of labor involved in assembling the door and eliminates the need to use adhesives and solvents that are toxic and present waste disposal problems. Since the labor cost has been a major factor in the prior impact door technology, the invention offers the promise of producing high quality impact doors at a substantially lower cost that has heretofore been possible. The time required to be spent in producing doors is substantially reduced due to the fact that a number of manual labor intensive steps required by the prior procedures have been eliminated. Another important feature of the invention is that it makes it possible to use vacuum forming to provide contoured door panels. In particular, use of vacuum forming technology makes possible door panels with protuberances that can function as bumpers and/or kick or wear panels. The vacuum forming technology also makes possible novel window mounting arrangements. Other significant advantages are elimination of a separate stile member and an external metal mount for the stile and the pivot post.

Although the foregoing specification and drawings have described various modifications of the invention, it is expected that persons skilled in the art will utilize the foregoing description to devise other modifications not described hereinabove. Accordingly, the scope of this invention is to be determined by the following claims considered in light of the prior art and the teachings presented by the foregoing specification.

What is claimed is:

1. An impact traffic door comprising in combination:

a frame comprising a plurality of peripheral frame members enclosing an interior open space, and at least one coplanar interior frame member traversing said interior open space and subdividing said open space into two or more compartments;

each frame member being made of an untrasonically weldable plastic material and comprising first and second flat opposite surfaces each having at least one ultrasonic energy-concentrating strip, and a pair of door face panels each made of an ultrasonically weldable plastic material, said panels being disposed parallel to one another adjacent to and covering said first and second opposite surfaces respectively of said frame members, said first and second panels being ultrasonically welded to said first and second opposite surfaces respectively of said peripheral and interior frame members at said energy-concentrating strips, whereby said frame and said panels form an integral structure.

2. A door according to claim 1 wherein said frame members are not bonded directly one to another.

3. A door according to claim 1 wherein portions of said peripheral frame members protrude beyond the periphery of said panels.

4. A door according to claim 1 wherein said frame members are hollow and have an exterior surface with a polygonal configuration in cross-section.

5. A door according to claim 4 wherein said first and second opposite surfaces are outside surfaces of I said frame members.

6. A door according to claim 1 wherein said at least one interior frame member has a rectangular cross-section.

7. A door according to claim 1 wherein each of said frame members has two or more ultrasonic energy-concentrating strips on each of said first and second surfaces thereof.

8. A door according to claim 7, wherein said energy-concentrating strips are raised ribs on said first and second opposite surfaces.

9. A door according to claim 1, wherein at least one of said peripheral frame members comprises a hollow rectangular section and a hollow nose-shaped section; and said first and second opposite surfaces constitute opposite surfaces of said hollow rectangular section.

10. A door according to claim 9 further including a door post disposed in said nose-shaped section.

11. A door according to claim 10 wherein said nose-shaped section comprises two opposed side portions and two corner portions that cooperate to locate said door post in said nose-shaped section.

12. A door according to claim 11 wherein said side portions converge on one another away from said corner portions.

13. A door according to claim 11 wherein said side portions of said nose-shaped sections are joined by a connecting portion having a "T" shaped slot that extends for the length of said frame member.

14. A door according to claim 13 further including a flexible seal disposed in said "T"-shaped slot, said seal extending outwardly of said frame.

15. A door according to claim 14 further including a stiff seal-retaining strip in said slot.

16. A seal according to claim 14 wherein said seal comprises a strip of resilient material convoluted so as to provide a rear portion that surrounds and is anchored by said stiff retaining strip.

17. A door according to claim 1 wherein each of said peripheral frame members comprises a hollow section having a rectangular cross-sectional shape and a hollow nose-shaped section, said peripheral frame members being arranged to define a rectangular frame, and the ends of said peripheral frame members being mitered to form right angle corners for said rectangular frame.

18. A door according to claim 17 further including a pivot shaft mounted in the nose-section of one of said peripheral frame members.

19. A door according to claim 18 further including mechanical fasteners securing said pivot shaft to said one peripheral frame member.

20. A door according to claim 1, wherein said peripheral frame members have recessed surfaces on two opposite sides thereof with said energy-concentrating strips being formed on said recessed surfaces, and said face panels are ultrasonically welded to said recessed surfaces.

21. A door according to claim 1 wherein at least one of said panels comprises a plurality of vacuum-formed bulbous sections projecting outwardly of the plane of said panel.

22. A door according to claim 21 wherein said plurality of bulbous sections extend widthwise of said panels.

23. A door according to claim 21 wherein said door has a pivot axis, and said plurality of bulbous sections extend parallel to said axis.

24. A door according to claim 21 wherein said door has a pivot axis, and said plurality of bulbous sections extend at a right angle to said axis.

25. A door according to claim 1, wherein said compartments are filled with energy absorbing means for deadening mechanical shock and sound.

26. A door according to claim 25 further including a flexible seal attached to one of said peripheral frame members, said seal extending lengthwise of and projecting outwardly of said one peripheral frame member.

27. A door according to claim 24 wherein said flexible seal is an elongate member that is disposed in a groove in said one peripheral frame member.

28. A door according to claim 1 further including a replaceable nosing member removably attached to one of said peripheral frame members.

29. An impact traffic door comprising in combination:

a frame comprising a plurality of peripheral frame members enclosing an interior open space, and at least one coplanar interior frame member traversing said interior open space and subdividing same into two or more compartments;

each frame member being made of a thermoplastic material and comprising first and second oppositely-facing surfaces that extend parallel to one another, each frame member also having at least one energy-concentrating strip extending along each of said first and second oppositely-facing surfaces; and first and second door face panels each made of a thermoplastic material, said panels being disposed parallel to one another adjacent to and covering said first and second oppositely facing surfaces, said panels being welded to said oppositely facing surfaces at said energy-concentrating strips so as to form an integral structure;

said first and second panels each including an aperture defining a window opening, with the aperture in said first panel being smaller than the aperture in said second panel so that the edge of said first panel defining said window opening being exposed to function as a glazing surface;

a window panel engaged with said glazing surface; and a frame member attached to said second panel and overlapping said window pane so as to hold it against said glazing surface.

30. An impact traffic door comprising in combination:

a frame comprising a plurality of peripheral frame members enclosing an interior open space, and at least one coplanar interior frame member traversing said interior open space and subdividing same into two or more compartments;

each frame member being made of a thermoplastic material and comprising an elongate beam having at least two opposed energy-concentrating strips first and second oppositely-facing surfaces that extend parallel to one another, each frame member also having at least one energy-concentrating strip on each of said first and second oppositely-facing surfaces; and first and second door face panels each made of a thermoplastic material, said panels being disposed parallel to one another adjacent to and covering said first and second oppositely-facing surfaces of said frame members, said panels being ultrasonically welded to said frame members at said energy-concentrating strips, said panels enclosing said interior space;

said first and second panels having first and second apertures respectively with said first and second apertures being in registration with one another;

each of said apertures having a peripheral edge defining a window opening;

additional frame members between said panels arranged to form a window frame aligned with said window openings; and first and second window frames disposed in said window openings and bonded to opposite sides of said window frame.

31. An impact traffic door comprising in combination:

a frame comprising a plurality of peripheral frame members enclosing an interior open space, and at least one coplanar interior frame member traversing said interior open space and subdividing said open space into two or more compartments;

each frame member being made of an untrasonically weldable plastic material comprising first and second flat opposite surfaces each having at least one ultrasonic energy-concentrating strip;

at least one of said peripheral frame members comprising a hollow rectangular section and a hollow nose-shaped section, with said first and second opposite surfaces constituting opposite surfaces of said hollow rectangular section; and a pair of door face panels each made of an ultrasonically weldable plastic material, said panels being disposed in parallel relationship to one another adjacent to and covering said first and second opposite surfaces respectively of said frame members, said first and second panels being ultrasonically welded to said first and second opposite surfaces respectively of said peripheral and interior frame members at said energy-concentrating strips, whereby said frame and said panels form an integral structure.

32. A door according to claim 31 further including a door post disposed in and extending lengthwise of said nose-shaped section.

33. A door according to claim 31 wherein said panels do not cover said nose section of said at least one peripheral frame member.

34. An impact traffic door comprising in combination:

a frame consisting of a plurality of peripheral frame members enclosing an interior open space, and at least one coplanar interior frame member traversing said interior open space and subdividing same into two or more compartments;

each frame member being made of a thermoplastic material and comprising first and second oppositely facing flat surfaces that extend parallel to one another, each frame member also having at least one energy-concentrating strip on each of its said first and second oppositely facing flat surfaces; and first and second door face panels each made of a thermoplastic material, said first and second panels being disposed parallel to one another in adjacent and covering relation with said first and second oppositely facing surfaces, said panels being welded to said oppositely facing surfaces at said energy-concentrating strips, whereby said frame and said panels form an integral structure.

* * * * *

UNITED STATES PATENT AND TRADEMARK OFFICE

CERTIFICATE OF CORRECTION

PATENT NO. : 5,459,972
DATED : October 24, 1995
INVENTOR(S) : Alan Eckel

It is certified that error appears in the above-indentified patent and that said Letters Patent is hereby corrected as shown below:

Claim 5, column 14, line 62, delete "I" before the word -- said --; and

Claim 27, column 16, line 1, the numeral "25" should be -- 26 --.

Signed and Sealed this

Thirtieth Day of January, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,459,972

DATED : Oct. 24, 1995

INVENTOR(S) : Alan Eckel

It is certified that error appears in the above-indentified patent and that said Letters Patent is hereby corrected as shown below:

Claim 5, column 14, line 62, delete "I" before the word —said—; and

Claim 27, column 16, line 1, the numeral "24" should be —26—.

This certificate supersedes certificate of correction issued January 30, 1996.

Signed and Sealed this

Twenty-sixth Day of March, 1996

Bruce Lehman

*Attest:*

BRUCE LEHMAN

*Attesting Officer*

*Commissioner of Patents and Trademarks*